United States Patent [19]

Day

[11] 4,214,023

[45] Jul. 22, 1980

[54] ORNAMENTAL DEVICE

[76] Inventor: Nancy C. Day, 100 Morgan St., Roxboro, N.C. 27573

[21] Appl. No.: 894,355

[22] Filed: Apr. 5, 1978

[51] Int. Cl.[2] ..... A47G 33/08

[52] U.S. Cl. ..... 428/11; 428/102; 428/280

[58] Field of Search ..... D11/121, 124, 125; 428/11, 53, 280–282, 102, 104; 362/121, 807; 156/63, 91, 93, 227, 292

[56] References Cited

U.S. PATENT DOCUMENTS

| | | | |
|---|---|---|---|
| D. 157,156 | 2/1950 | Janowitz | D11/121 |
| D. 161,160 | 12/1950 | Burros | D11/121 |
| 1,653,206 | 12/1927 | Friedrich | 428/11 X |
| 2,067,241 | 1/1937 | Neidinger | 428/11 X |
| 2,191,041 | 2/1940 | Protz | 428/11 X |
| 2,206,059 | 7/1940 | Slayter | 428/280 X |
| 2,652,653 | 9/1953 | Ober | 428/11 X |
| 2,659,993 | 11/1953 | Raymond | 428/7 |
| 2,809,455 | 10/1957 | De Haven | D11/121 X |

*Primary Examiner*—Henry F. Epstein

*Attorney, Agent, or Firm*—Clarence A. O'Brien; Harvey B. Jacobson

[57] ABSTRACT

An ornamental device defined by three identical, normally planar pieces of flexible material, such as fabric or the like, secured together along adjacent peripheral edges to provide a three-dimensional ornamental device. The ornamental device may be constructed of many shapes and configurations including the disclosed embodiment in the form of a Bethlehem star having seven points and the three planar pieces being constructed of fabric in the form of a five point star. A central portion of the lower portion of the connected peripheral edges of the three fabric pieces is left unattached, thereby providing an opening to the hollow interior of the ornamental device to enable it to be installed at the upper end of a Christmas tree trunk by inserting the upper end of the trunk into the opening, thereby enabling the star to be used as a Christmas tree top ornament. Many other ornamental devices may be constructed by utilizing the same construction technique.

1 Claim, 4 Drawing Figures

ORNAMENTAL DEVICE

BACKGROUND OF THE INVENTION

1. Field of the Invention

The present invention generally relates to an ornamental device of three-dimensional characteristics constructed from three identical planar members of flexible material having adjacent peripheral edge portions secured together with the disclosed embodiment of the ornamental device being in the form of a three-dimensional star constructed of three planar fabric pieces each of which is star shaped with five points to form a seven pointed three-dimensional star.

2. Description of the Prior Art

Ornamental devices of various configurations have previously been constructed by using a plurality of components secured together in various manners. For example, multiple flexible panels may be secured together along a vertical center line with the multiple panels being disposed in angular relation to each other radiating from the center line in order to provide a three-dimensional ornamental device. Examplary U.S. patents illustrating such structures and other related ornamental devices are as follows: U.S. Pat. Nos. 1,653,206—Dec. 20, 1927; 2,067,241—Jan. 12, 1937 U.S. Pat. Nos. Des. 157,156—Feb. 7, 1950 and 161,160—Dec. 12, 1950.

SUMMARY OF THE INVENTION

An object of the present invention is to provide an ornamental device of three-dimensional characteristics constructed from three identical flexible panels secured together along adjacent peripheral edge portions in a manner to provide a hollow body including radially extending peripheral edge portions.

Another object of the invention is to provide an ornamental device in which the three flexible planar panels are in the form of flexible fabric material of two-dimensional characteristics having multiple points to form an ornamental star having more radiating points than the number of points on the flexible panels.

Still another object of the invention is to provide an ornamental device in accordance with the preceding objects in which each of the panels is in the form of a five pointed star with the resultant ornamental device being in the form of a seven pointed star.

A further object of the present invention is to provide an ornamental device in accordance with the preceding objects in which a central lower peripheral edge portion of the body is left open to receive a supporting structure such as the upper end of a Christmas tree trunk thereby enabling the device to be used as a Christmas tree tree top ornament.

Yet another important object of the invention is to provide an ornamental device which is relatively simple in construction, attractive in appearance, unique in the assembly technique and relatively inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
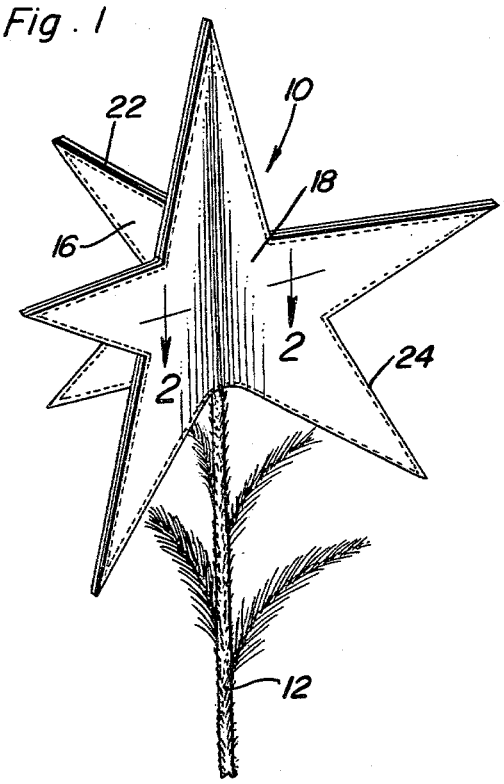
FIG. 1 is a perspective view of the ornamental device of the present invention in the form of a Bethlehem star mounted at the top of a Christman tree.

Referring now specifically to the drawings, the ornamental device in the form of a star is designated by reference numeral 10 and is illustrated in use as a tree top ornament mounted at the upper end of a Christmas tree trunk 12. The ornamental device 10 may be utilized in other orientations on a Christmas tree or by varying the shape and configuration thereof, it may be utilized for various decorative and ornamental purposes.

The ornamental device 10 is constructed of three identical panels 14, 16 and 18 each of which are of identical construction and preferably constructed of fabric or similar flexible material, such as felt, of any desired color or having any desired decorative pattern compatible with the ornamental purposes for which the ornamental device is intended.

The ornamental star 10 is constructed by utilizing three identical panels each of which have five radially extending points 20, thus forming a five pointed two-dimensional star. In the initial assembly step, as illustrated in FIG. 3, the panels 14 and 16 are secured together by stitching or other securing means indicated by broken line 22 from the tip end of one point 20 along the side of that point and around the periphery of the next two points with the line of securement 22 terminating at the juncture between the two points directly opposite to the point 20 where the line of securement 22 starts so that substantially one-half of the periphery of the panels 14 and 16 are secured together by the line of securement 22 and the other half of the panels 14 and 16 are free of each other, thus providing a structure as illustrated in FIG. 3, which is then assembled with the third panel 18 in the manner illustrated in FIG. 4.

Figure 2:
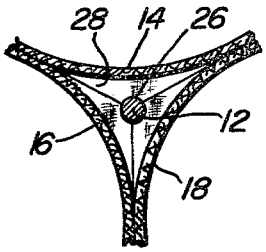
FIG. 2 is a fragmental sectional view taken substantially upon a plane passing along section line 2—2 on FIG. 1 illustrating the hollow interior of the body of the ornamental star illustrating the relationship of the panels and the upper end of the tree trunk inserted into the interior of the body.
Figure 3:
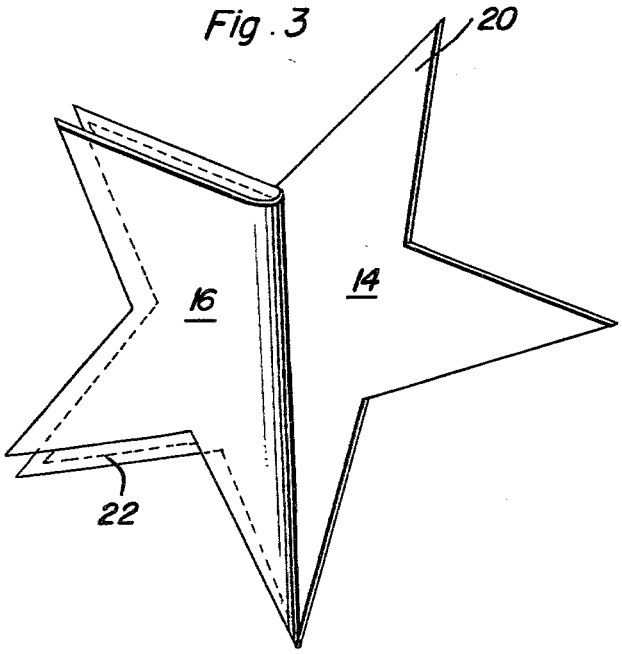
FIG. 3 is a plan view illustrating the resultant of attaching the first two panels together about a portion of their periphery.
Figure 4:
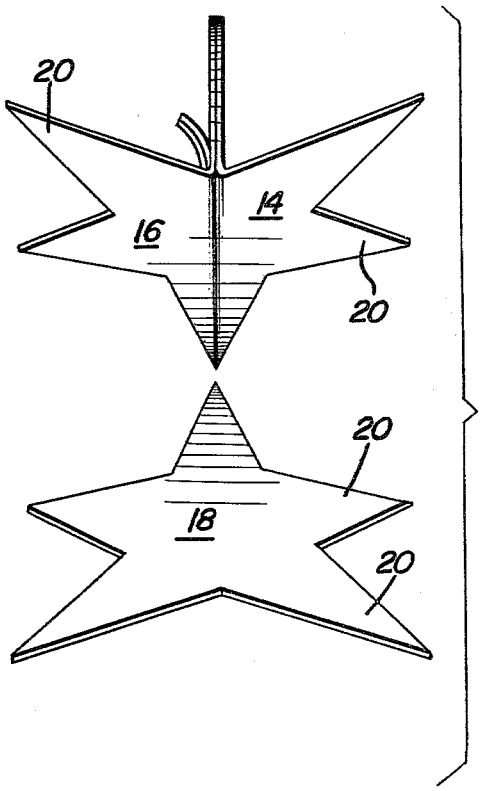
FIG. 4 is a perspective view illustrating the manner in which the two panels assembled in the manner of FIG. 3 are attached to the third panel to provide the completed ornamental star.

In this step of construction, the two panels 14 and 16 joined together in the manner illustrated in FIG. 3 have their free portions extending outwardly from each other to define a five point configuration of the same shape and size as the panel 18. This assembly of panels 14 and 16 is connected to the panel 18 by a line of securement 24 is illustrated in FIG. 1 with this line of securement extending completely around the periphery of the panel 18 and the peripheral edge portions of the laterally extending unattached portions of the panels 14 and 16. When the panels are constructed of fabric material, stitching may be used to secure the adjacent peripheral edges of the panels together or other means may be provided for securing the panels together if other materials are used. Also, the line of securement between the panels may be interrupted for a short distance at the lower end of the ornamental device to define an opening 26 therein for penetration of the tree trunk 12 as illustrated in FIG. 2 which also illustrates the hollow interior 28 of the central body of the ornamental device which is formed by the natural tendency of the flexible material to pull away from each other at the central portions of the panels which are not attached to each other, thereby providing a hollow interior to the body of the ornamental device.

Depending upon the purposes for which the ornamental device is to be used, various decorative reflective material, glitter, tape, appliques, or the like, may be secured to the external surface of the ornamental device. As illustrated, the ornamental star when completed by using the three planar panels each of which have five points produces a three-dimensional Bethlehem star with seven radial points. Also, the ornamental device may be constructed in various shapes and configurations with or without an entrance aperture in the lower end thereof. By increasing the dimensions thereof, the star could be utilized as a head piece or head covering as part of a costume by placing the hollow body downwardly over the head of a person wearing the device. By constructing the device of other shapes and configurations, various ornamental devices of three-dimensional characteristics may be constructed in which three panels are secured in the manner disclosed and, in some instances, it may be desirable to fill the hollow interior of the ornamental device with any suitable flexible or resilient filler, padding, and the like.

Also, the device is adapted to be constructed by individuals having reasonable craft skills. For example, the components of the ornamental device may be provided in kit form with suitable instructions in order to enable a purchaser of a kit to assemble the ornamental device, thereby enabling such individual to enjoy the accomplishment of producing their own individualized ornamental devices.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An ornamental device comprising three identical, normally planar, flexible panels, each of the panels being completely solid and imperforate with its perimeter being continuous and uninterrupted, means securing substantially one-half of adjacent peripheral edges of two of the panels together while leaving the remainder of the panels unattached, and means securing substantially all of the periphery of the third panel to the unattached one-half peripheral edge portions of the first two panels while leaving the remainder of the third panel unattached to provide a three-dimensional ornamental device having a hollow central body area and radially extending peripheral edge portions disposed in three different radial planes with the panels being connected together only at their peripheral edges with the central body area of the panels being free of each other, each of said panels being in the form of a five pointed, two-dimensional star forming a seven pointed three-dimensional star when assembled with only the peripheral edges of the star points being connected, each of said panels being constructed of flexible fabric material such as felt and the means for securing the peripheral edges of the panels together is in the form of stitching thereby forming a self-sustaining but flexible ornamental device in which the central areas of the panels may be removed apart, the bottom central area of the central body defined by the stitching including an aperture formed by interrrupting the stitching along a lower central peripheral portion of the panels for a short distance for reception of a Christmas tree trunk, branch, or the like, to enable the ornamental device to be used as the top ornament or other ornament on a Christmas tree.

* * * * *